US006135046A

United States Patent [19]

Beech

[11] Patent Number: 6,135,046

[45] Date of Patent: Oct. 24, 2000

[54] SPRING BIASED DRIFT ANCHOR

[76] Inventor: Joseph Beech, 1281 330 Ave., Tracy, Minn. 56175

[21] Appl. No.: 09/285,572

[22] Filed: Apr. 2, 1999

[51] Int. Cl.[7] ..... B63B 21/48

[52] U.S. Cl. ..... 114/311

[58] Field of Search ..... 114/311; D12/215; 383/33

[56] References Cited

U.S. PATENT DOCUMENTS

| | | | |
|---|---|---|---|
| 1,575,134 | 3/1926 | Stocking | 114/311 |
| 1,897,018 | 2/1933 | Draheim . | |
| 2,818,042 | 12/1957 | Manhart | 114/311 |
| 4,481,900 | 11/1984 | Rutten et al. | 114/311 |
| 4,753,423 | 6/1988 | Ukai et al. | 267/286 |

*Primary Examiner*—Sherman Basinger
*Attorney, Agent, or Firm*—D. L. Tschida

[57] ABSTRACT

A sea anchor having a leading edge that is outfitted with a flexible, resilient hoop member that biases the leading edge to self-expand. The hoop member is constructed from a material having no shape retaining memory and in a presently preferred form comprises a looped length of a coated spiral spring. A relatively substantial float extends along a substantial portion of the leading edge circumference and is mounted between a pair of short tether lines. Weights are mounted to the leading edge diametrically opposite the float and between a pair of longer tether lines. Vents mounted between the float and trailing edge release trapped air as the anchor inflates with collected water. A retrieval line is secured to guides along the length of the anchor and a storage strap is secured to the anchor.

12 Claims, 3 Drawing Sheets

SPRING BIASED DRIFT ANCHOR

BACKGROUND OF THE INVENTION

The present invention relates to boat control devices and, in particular, to a sea anchor, also referred to as a drift anchor or drift sock, that has a resiliently biased leading edge and associated venting, flotation, weighting, retrieval and storage capabilities.

Varieties of sea anchors have been developed to control the drift and/or passive movement of watercraft. Each principally provides a conical or tubular body that tapers from a relatively large leading edge to a narrowed trailing edge. When tethered to a watercraft and drawn through the water, the anchor collects and displaces a volume of water that adds drag. The surface drift speed of the watercraft is thereby reduced.

U.S. Pat. No. 5,394,817 discloses a cylindrical drift anchor having control lines that control the exposed aperture of a trailing edge in a range from completely closed to fully opened.

U.S. design patent DES 329,220 discloses another conical, frustum shaped drift anchor having relatively small weights and floats distributed about the circumference of the leading edge. A draw tie at the trailing edge controls aperture exposure.

U.S. Pat. No. 4,534,306 discloses a tandem array of anchors secured to a common drag control line.

A further problem inherent to known drift anchors is the relatively long time it takes each to deploy in the water. That is, when dropped into the water, a certain amount of time is required for the leading edge of the drift anchor to become orientated and expand to a fully open condition. Prevailing winds, waves, boat motion, trapped air and fouled tether and retrieval lines can further delay the expansion of the anchor.

Drift socks have also been sold by Cabela's Corp. that attempted to solve this problem by providing a rigid hoop at the leading edge of the anchor. The hoop was constructed of a number of interconnecting segments that disassembled for storage. A principal deficiency of the anchor, however, was that the hoop segments were prone to break and kink, thereby necessitating continuous maintenance.

The present drift anchor was constructed to enhance the deployment rate of a drift anchor and overcome the deficiencies of predecessor anchors. The leading edge is particularly fitted with a flexible, resilient member that spring biases the leading edge to self-expand to an open condition. Associated, variable length tether lines, floatation, weighting and venting assemblies facilitate the self-orientation of the drift anchor. Retrieval guides contain a retrieval line and minimize line fouling.

SUMMARY OF THE INVENTION

It is accordingly a primary object of the invention to provide a drift control device having a resiliently biased leading edge.

It is a further object of the invention to provide a drift anchor having a flexible, resilient hoop secured to the leading edge that self-expands to spring bias the edge to an open condition and thereby expose the fore-end aperture to enhance inflation with water.

It is a further object of the invention to provide a float member of substantial length along a portion of the circumference of the leading edge to define a top surface of the anchor and a plurality of weights positioned opposite the float.

It is a further object of the invention to provide a plurality of vents along the top surface of the drift anchor to vent trapped air.

It is a further object of the invention to provide a plurality of tether lines of differing length and wherein the longer lines mount to the weighted portion of the leading edge and the shorter lines mount to the float containing portion of the leading edge of the drift anchor.

It is a further object of the invention to provide guides affixed along the length of the anchor to prevent fouling of the retrieval and tether lines.

It is a further object of the invention to provide a mechanism for controlling the exhaust aperture at the trailing edge.

It is a further object of the invention to provide a mechanism for storing tether and retrieval lines to the body of the drift anchor.

Various of the foregoing objects, advantages and distinctions of the invention are obtained in one presently preferred drift anchor. The anchor is constructed from a number of triangular fabric panels that are sewn to a conical shape. Tether lines or straps of differing lengths extend from a leading edge hem and at the seams between the panels. A trailing edge is fitted with a fastener to control the exposure of the exhaust aperture. A retrieval line extends from the trailing edge and through a guide at the leading edge.

The circumference of the leading edge is outfitted with a flexible, resilient hoop member that self-expands the leading edge. The resilient member is selected from a memory-less material that in a presently preferred form provides an extrusion coated spiral spring. A float sized to extend substantially the width of one panel is mounted to the leading edge between a pair of short tether lines. Weights are mounted to the leading edge opposite the float and between a pair of longer tether lines. The resilient member, floats and weights self-orientate the drift anchor in the water as the resilient member expands the leading edge.

Vents fitted between the float and trailing edge allow trapped air to escape from the interior of the anchor as the anchor inflates with collected water.

Still other objects, advantages, distinctions and constructions of the invention will become more apparent from the following description with respect to the appended drawings. Similar components and assemblies are referred to in the various drawings with similar alphanumeric reference characters. The description should not be literally construed in limitation of the invention. Rather, the invention should be interpreted within the broad scope of the further appended claims.

BRIEF DESCRIPTION OF THE DRAWINGS

Similar structure at the drawings is referred to with the same reference numerals and/or characters.

DESCRIPTION OF THE PREFERRED EMBODIMENT

Figure 1:
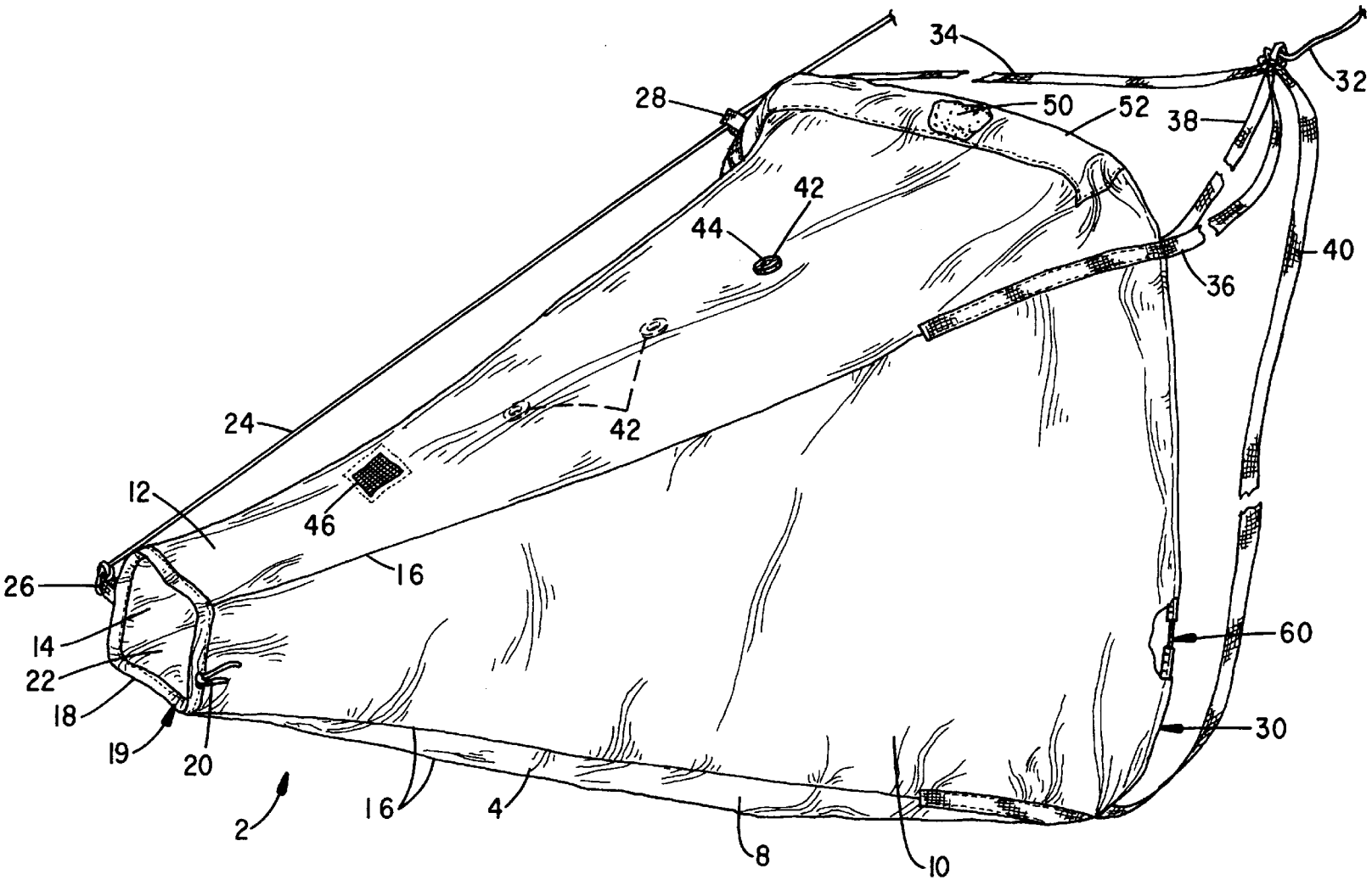
FIG. 1 is a perspective view shown in partial cutaway and exposing the exterior surface of the drift anchor.
Figure 2:
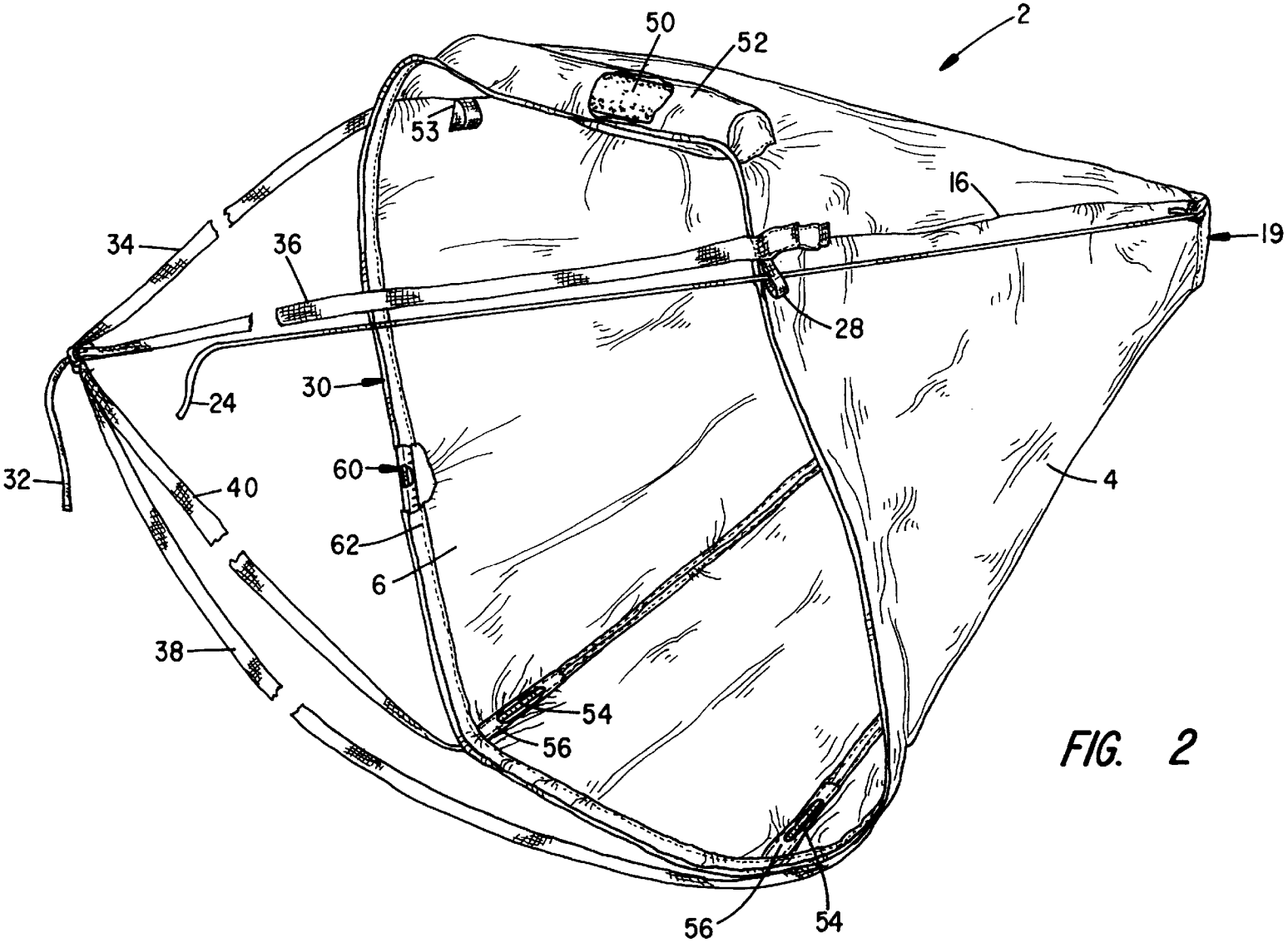
FIG. 2 is a perspective view shown in partial cutaway and exposing the interior surface of the drift anchor.

Referring to FIGS. 1 and 2, perspective views are shown in partial cutaway to the drift anchor 2 as it appears when inflated with water. Exterior and interior surfaces 4 and 6 of the drift anchor 2 are exposed to display various features that enhance deployment.

The drift anchor 2 is constructed from four triangular panels 8, 10, 12 and 14 that are sewn together at longitudinal seams 16. A variety of fabrics and materials of various weights, colors, textures and treatments can be used. A 150 denier rip-stop polyester material and 92 weight polyester thread is presently preferred, although a similar material of 100 to 300 denier might also be used. This material is relatively resistant to water absorption and remains relatively pliable without becoming limp under normal conditions and temperatures. The material thereby doesn't compact or stick to itself upon removal from the water. During deployment, it similarly doesn't sag or droop over its length, which can create folds that effect the expansion rate, each time it is admitted to the water.

A hem 18 at the trailing edge 19 includes a drawstring 20. The drawstring 20 permits adjustment of the exposure of an exhaust aperture 22. A variety of other fasteners (e.g. hook and loop tabs, snap fasteners etc.) can be used to effect a similar adjustment of the exposure at the exhaust and/or inlet apertures.

A retrieval line 24 is secured to a grommet at a tab 26 that extends from the hem 18. The retrieval line 24 extends along the top of the exterior surface 4 to a loop 28 that projects from a leading edge 30. Upon pulling on the line 24, the trailing edge 19 is drawn forward to collapse the anchor 2. Trapped water is expelled and the anchor 2 can be retrieved via a tow or tether rope 32 that is secured to a number of tether straps 34, 36, 38 and 40 that extend from the leading edge 30. The tether straps are cut from an appropriate ¼ to 1½-inch webbing and are sewn to the seams 16.

The tether straps 34 and 36 are cut to the same length and are cut in a range 4 to 10 inches shorter than the pair of straps 38 and 40. The longer straps 38 and 40 allow the bottom of the leading edge 30 to unfurl, sink and collect water faster than heretofore possible. A reduced angle between the tether rope 32 and watercraft is also presented, which in combination with the positioning of the retrieval line 24 reduces line drag during retrieval.

Secured to the panel 12 is a plastic vent 42. Other vents 42 (shown in dashed line) can be mounted to the panel 12. The vents 42 allow trapped air to escape faster without having to wait to be expelled at the exit aperture 22. The vents 42 are constructed from nylon grommets. Each vent 42 provides a bore 44 that allows trapped air to escape.

A polyester screen panel 46 is also sewn into the panel 12 approximately one-fourth to one-third the distance between the leading and trailing edges 30 and 19. The panel 46 vents the anchor 2, but principally prevents the anchor 2 from twisting, spinning or rotating as it unfurls over its length. The potential of restrictions and twists is thereby reduced in the fabric, tether straps 34–40 and/or towrope 32. A 1½×1½ inch panel 46 is presently used, although the size of the panel 46 can be varied.

Proper orientation of the retrieval line 24, vents 42 and panel 46 is obtained with the aid of a relatively substantial float 50. The float 50 is secured in a sewn pocket 52 at the leading edge 30, between the tether straps 34 and 36. A length of ¾ to 1½ inch diameter, closed cell foam is used to form the float 50. A variety of foams and other buoyant materials can be used to obtain proper floatation. The float 50 is approximately 18 to 24 inches long, although can extend in a range from 15% to the length of the space between the straps 34 and 36. The float may also extend past the straps 34 and 36 or might be constructed in segments that extend over the foregoing portion of the circumference at the leading edge 30. The length and rigidity of the float 50 also allows the float 50 to serve as a handle. Lengths of hook and loop fastener material 53 are secured to the interior of the surface 6 to secure the collected straps between usage of the anchor 2.

Lead weights 54 are also sewn into pockets 56 at the seams 16 at the attachment points of the straps 38 and 40, reference FIG. 2. The weights 54 cause the portion of the leading edge 30, opposite the float 50 to sink. The expansion of the leading edge 30 opens the anchor to collect water. Presently 4 ounces of weights 54 are provided at each seam 16. The location of the weights 54 and total weight added can be adjusted as desired.

The expansion of the leading edge 30 is particularly enhanced by a flexible, resilient hoop member 60 that is sewn into a hem 62 that spans the circumference of the leading edge 30. The resilient member 60 is formed in the shape of a closed hoop from a material that has no shape memory and is mounted to spring bias the leading edge 30 to an open condition that exposes the interior of the anchor 2. The member 60 can be folded and rolled along with the fabric for storage.

A variety of flexible and resilient materials can be used to form the member 60. Various solid, wound and/or tubular plastics, nylons or composite materials might be used. A selected material preferably should be impervious to water, the sun, typically encountered temperatures and other typical environmental conditions. The material should not have a shape retaining memory. That is, the material should not kink or twist during use and should not develop any kinks or twists over time. Instead, it should repeatedly expand to a hoop form to cause the leading edge 30 to deploy into a circle or other defined shape.

Continuous or intermittent lengths of the material might also be secured to the leading edge 30. That is, multiple members 60 might be secured to the leading edge 30 without forming a closed loop. Multiple hoop members 60 or partial hoop members 60 (e.g. quarter to half circular lengths of the material used to construct the member 60) might also be displaced from each other along the length of the anchor 2, intermediate the leading and trailing edges 30 and 19. Potential intermediate sagging of the anchor 2 can thereby be avoided.

Figure 3:
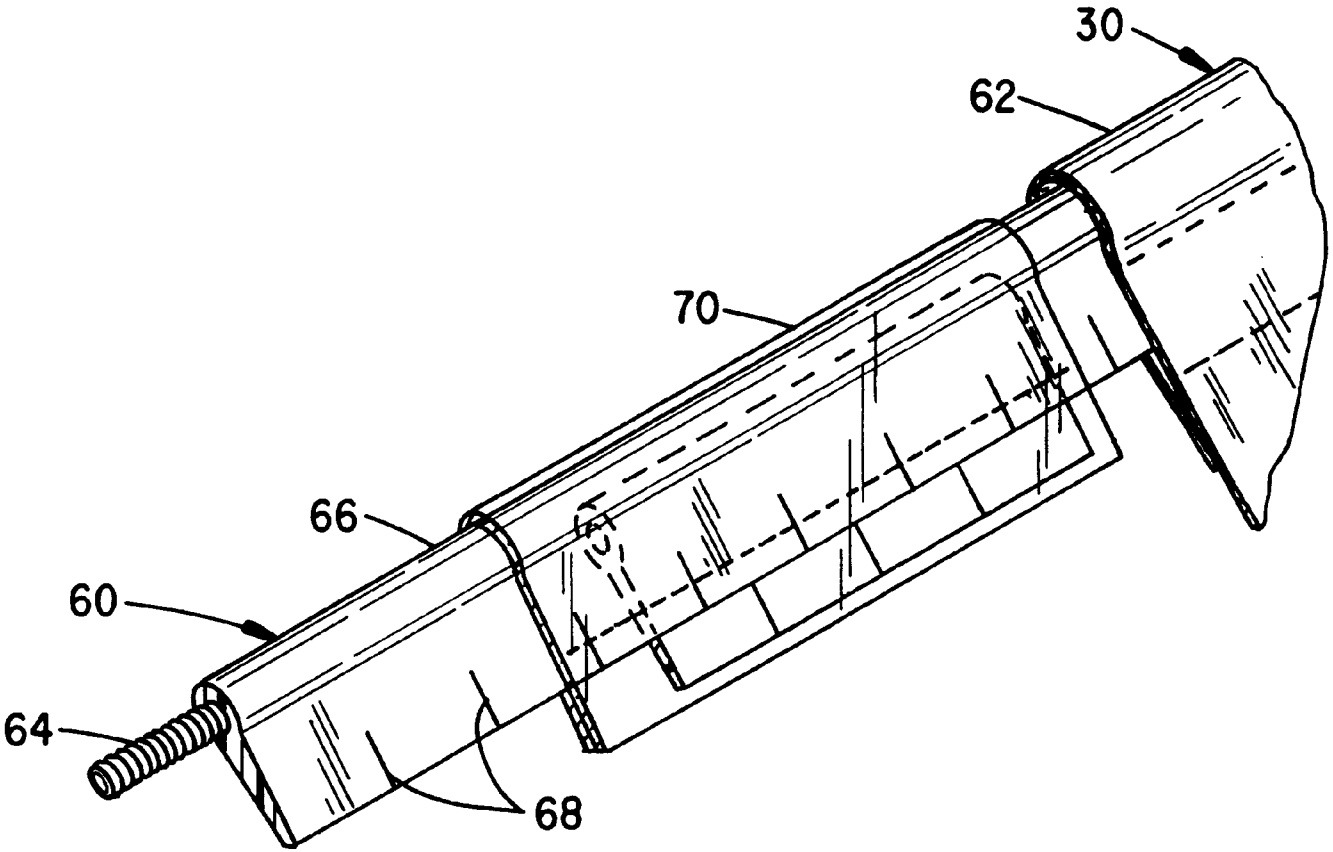
FIG. 3 is a perspective view shown in expanded scale to the resilient expansion member and a sealed joint.

A presently preferred member 60 is shown at FIG. 3. The member 60 is constructed from a spiral wound metal core 64 that is covered with an extruded polyvinyl web 66. The core 64 can be constructed of a variety of wound materials. The present core exhibits a ⅛ inch diameter, although could exhibit a diameter in an exemplary range from ⅛ to ⅜ inches. The weight of the metal core 64 facilitates the sinking of the leading edge 30, as it expands. The web 66 is typically sewn into the hem 62 to align the member 60 to the anchor 2. Slits or relieves 68 are cut into the edge of the web 66 and allow the member 60 to flex and bend.

Also shown at FIG. 3 is a tubular water-impermeable seal 70 that covers overlapped ends of the member 60. The ends and seal 70 are sewn together to provide a waterproof closure to prevent corrosion at the core 64. A gel sealant can be injected into the seal 70.

The drift anchor 2 can be constructed to any desired size and geometric shape having a through bore (e.g. pyramidal or conical frusta, cylindrical, among others). An anchor 2 that deploys to a conical, frustum shape that is 4 feet long and has a 134-inch circumference at the leading edge 30 and 20-inch circumference at the trailing edge 19 accommodates boats 16 to 19 feet in length. A comparable anchor 2, except that has a 158-inch circumference at the leading edge 30, has been found adequate to support use with boats up to 22 feet. Multiple anchors 2 can also be used to increase drag. The present anchors 2 also support use with watercraft operated under power. The anchor 2 facilitates boat control. The construction of the anchor 2 has demonstrated sufficient strength to withstand the additional stress and not tear.

While the invention has been described with respect to a preferred construction and considered improvements or alternatives thereto, still other constructions may be suggested to those skilled in the art. Selected ones of the foregoing features can also be arranged in different combinations. The foregoing description should therefore be construed to include all those embodiments within the spirit and scope of the following claims.

What is claimed is:

1. Drift control apparatus comprising:

a) a fabric member that deploys to a frustrum shape and has a bore that extends between leading and trailing edges, wherein a circumference of the leading edge is substantially greater than the circumference of the trailing edge, wherein a continuous floatation member is secured to said leading edge to extend at least 15% of the circumference of the leading edge, wherein said floatation member extends between first and second equal length straps that extend from said leading edge, wherein third and fourth equal length straps, which are longer than said first and second straps, extend from said leading edge diametrically opposite said first and second straps, and wherein a flexibly resilient, endless hoop is secured to extend around the circumference of the leading edge to bias the leading edge to self-expand to a fully open condition; and b) a plurality of vents secured to said fabric member between said floatation member and trailing edge and communicating with said bore, whereby said resilient hoop, floatation member, first, second, third and fourth straps and plurality of weights collectively cause said leading edge to rapidly expand and fill said bore with water as said vents expel air.

2. Drift control apparatus as set forth in claim 1 wherein said leading edge includes a plurality of weights mounted diametrically opposite said floatation member.

3. Drift control apparatus as set forth in claim 1 wherein said flexibly resilient, endless hoop comprises a spiral wound metallic member coated with a water impermeable material and having a web and wherein said web is sewn to said leading edge.

4. Drift control apparatus set forth in claim 1 including a retrieval line that extends along an exterior surface of said fabric member from said trailing edge and through a guide mounted to said fabric member adjacent the floatation member, whereby the trailing edge can be pulled forward to expel water from said bore.

5. Drift control apparatus as set forth in claim 1 wherein said floatation member comprises a length of closed cell foam having a diameter in the range of ¾ to 1½ inches and a length in the range of 18 to 24 inches.

6. Drift control apparatus comprising:

a) a fabric member that deploys to a tubular shape having a bore that extends between leading and trailing edges, wherein first and second equal length straps and third and fourth equal length straps are displaced equally from one another around the circumference of said leading edge, wherein said third and fourth straps are longer than said first and second straps, wherein a continuous floatation member that extends at least 15% of the circumference of the leading edge is secured to said leading edge between said first and second straps, wherein a plurality of weights are secured to said leading edge adjacent said third and fourth straps, and wherein a flexibly resilient, endless hoop is secured around the circumference of said leading edge to bias the leading edge to self-expand to an open condition; and b) a plurality of vents secured to said fabric member between said floatation member and said trailing edge and communicating with said bore, whereby said resilient hoop, floatation member, first, second, third and fourth straps and plurality of weights collectively cause said leading edge to rapidly expand and fill said bore with water as said vents expel air.

7. Drift control apparatus as set forth in claim 6 including a retrieval line that extends along an exterior surface of said fabric member from said trailing edge and through a guide mounted adjacent the floatation member, whereby the trailing edge can be pulled forward to expel water from said bore.

8. Drift control apparatus as set forth in claim 6 wherein said flexibly resilient, endless hoop comprises a spiral wound metallic member covered with a water impermeable web and wherein said web is sewn to the leading edge.

9. Drift control apparatus as set forth in claim 6 wherein one of said plurality of vents comprises a screen panel.

10. Drift control apparatus as set forth in claim 6 including means for varying an exposed aperture of said trailing edge.

11. Drift control apparatus as set forth in claim 6 including means for securing collected wraps of said first, second, third and fourth straps to the fabric member.

12. Drift control apparatus comprising:

a) a fabric member that deploys to a tubular shape having a bore that extends between leading and trailing edges, wherein first and second equal length straps and third and fourth equal length straps are displaced equally around and extend from said leading edge, wherein said third and fourth straps are longer than said first and second straps, wherein a continuous floatation member having a diameter in the range of ¾ to 1½ inches and a length in the range of 18 to 24 inches is secured to said leading edge between said first and second straps, wherein a plurality of weights are secured to said leading edge adjacent said third and fourth straps, and wherein a flexibly resilient, endless hoop comprised of a spiral wound metallic member covered with a water impermeable web is secured at said web to the leading edge to bias the leading edge to self-expand to an open condition;

b) a retrieval line that extends along an exterior surface of said fabric member from said trailing edge and through a guide mounted adjacent the floatation member; and c) a plurality of vents secured to said fabric member between said floatation member and said trailing edge and communicating with said bore, whereby said resilient hoop, floatation member, first, second, third and fourth straps and plurality of weights collectively cause said leading edge to rapidly expand and fill said bore with water as said vents expel air and said retrieval line can pull said trailing edge forward to expel water from said bore.

* * * * *